United States Patent [19]

Aeschlilmann

[11] Patent Number: 5,052,994

[45] Date of Patent: Oct. 1, 1991

[54] METHOD OF AND AN APPARATUS FOR SEALING A LIQUIDS PACKAGE

[75] Inventor: Hans-Peter Aeschlilmann, Tavel, Switzerland

[73] Assignee: Tetra Pak Holdings & Finance, Pully, Fed. Rep. of Germany

[21] Appl. No.: 492,985

[22] Filed: Mar. 12, 1990

[30] Foreign Application Priority Data

Mar. 21, 1989 [CH] Switzerland ..... 1032/89

[51] Int. Cl.[5] ..... B31B 1/84

[52] U.S. Cl. ..... 493/87; 493/102; 53/452; 156/217

[58] Field of Search ..... 493/85, 87, 88, 102, 493/114; 53/140, 452; 264/275, 277, 294, 295, 297.2, 123, 125; 156/217

[56] References Cited

U.S. PATENT DOCUMENTS

| | | | |
|---|---|---|---|
| 4,347,211 | 8/1982 | Bandoh | 264/297.2 |
| 4,604,850 | 8/1986 | Reil | 493/85 |
| 4,781,012 | 11/1986 | Reil et al. | 53/452 |
| 4,834,823 | 5/1989 | Reil | 493/102 |
| 4,844,327 | 7/1989 | Pausing | 493/114 |

FOREIGN PATENT DOCUMENTS

| | | |
|---|---|---|
| 0223094 | 5/1987 | European Pat. Off. . |
| 0257281 | 7/1987 | European Pat. Off. . |

*Primary Examiner*—D. S. Meislin
*Attorney, Agent, or Firm*—Paul & Paul

[57] ABSTRACT

A method is described for sealing at least one end of a liquids package, in the form of a tube (1), a top having wall panels (9, 10) with an opening means (11) and a bottom (3,6) and at least some of the wall panels (9,10) of the top (8) consisting of synthetic plastics coated papers, cardboard or the like carrier material and which includes the steps of first laying flat an already formed tube (1), open at the top and bottom in a plane (22') so that at least the wall panel (10) for the opening means (11) is positioned in this plane (22'), and so that an anchoring device (15,17,18) for the handle (14,14') is positioned on a lateral edge of the laid-flat tube (1) and a handle (14,14') is injection molded onto the tube (1) so that the main plane (22') of the handle (14,14') lies in the same plane (22,22') as the laid-flat tube (1) so that the handle (14,14') is fixed in the region of the top (8) of the package and simultaneously the opening means (11) is injection molded into place, and then the tube (1) together with the opening device (11) is unfolded and its wall panels (9,10) are folded over through about 90 degrees into the plane of the top to produce a flat top (8) and synthetic plastics bridges (13) are injection molded between the thus disposed wall panels (9,10). An apparatus to accomplish this method is described and comprises an injection mold die and a counter mold die which are driven so that they move towards each other. Each die is in one piece and has recesses for the synthetic plastic bridges, opening device or handle on that surface which is towards the other die.

1 Claim, 3 Drawing Sheets

METHOD OF AND AN APPARATUS FOR SEALING A LIQUIDS PACKAGE

FIELD OF INVENTION

The invention relates to a method of sealing at least one end of a liquid package, with a tube, a top with an opening means and a bottom and at least some of the wall panels of the top consisting of synthetic plastics coated paper, cardboard or like carrier material, the edges of the wall panels of the top being connected to one another in sealing-tight manner by injection moulded bridges of synthetic plastics material. The invention likewise relates to a method by which liquids packages are sealed, their tops not being fitted with opening means, in which case then a handle is mounted in the region of the package top. Finally, the invention also relates to an apparatus for sealing in the above-described manner, an injection mould die and a counter mould die being driven so that they move towards each other.

DESCRIPTION OF RELATED ART

It is known to produce liquids packages of the type described, in which the main body is the so-called paper tube. In the case of the packages of which the top and bottom are produced from the same paper material by folding, difficulties have been encountered especially where opening by the end user is concerned. Therefore, there has already been a trend towards injection moulding at least the synthetic plastics top onto the tube.

It is also known that liquid nutrients, particularly milk and juices, are packaged aseptically. It is important in this respect that as far as possible ingress of oxygen from the environment cannot pass through the packaging material and reach the contents of the package. Paper alone and also the synthetic plastics material used for coating or for moulding onto the tops or bottoms do not really constitute a barrier to oxygen. For aseptic packagings, therefore, preferably paper packages have been used which carry a coating of metal, e.g. aluminium, and manufacturers have resorted to that type of package which had paper walls on all sides including the top and bottom.

However, if it is desired to have better opening devices and at the same time sealing tightness with oxygen barrier properties, then a compromise has to be made, which is why it has already been suggested for the tube and the bottom of a package to be produced from paper and for the top, too, to be formed by wall panels folded over and constructed in one piece with the tube, the edges of these wall panels being connected to one another in fluid-tight fashion by injected bridges of synthetic plastics material. In fact, it was possible in this way also to injection mould an opening device in the top area, whether in the centre or at the edge, e.g. in one of the wall panels, which consist of the tube material and then, after the tube has been produced and folded over, to form the top from the plane thereof.

Such a state of the art has however produced the drawback that complicated injection moulding tools have to be used in order on the one hand to mould the bridges on the edges of the wall panels and on the other to form the opening means. The manufacturing methods became even more difficult. When such a liquids package also comprised a handle consisting at least partially and likewise of synthetic plastics material and which is anchored on the top, for example, by being moulded jointly with the top.

Here, too, attempts have already been made by using multi-part injection moulding dies or profiling rollers to employ suitable mould removal movements in the case of complicated configurations, but in practice it has been found that such machines are susceptible to breakdown, particularly in heavy-duty operations, i.e. when a plurality of tops have had to be produced with the combination of bridges and/or opening means and/or handles.

Therefore, the object of the invention is to provide a method of the type mentioned at the outset by which a simpler facility for injection moulding the synthetic plastics parts in the top zone is possible also with heavy duty operations, particularly in the case of packages the tops of which are formed at least partially of paper wall panels.

SUMMARY OF INVENTION

In order to resolve this problem, it is according to the invention envisaged that the tube which is open at the top and bottom ends should in a first stage be so laid flat in one plane that at least the top wall panel for the opening device comes to a position in this plane after which at least the opening device is injection moulded into it and then, in a second stage, the tube is unfolded together with the opening device and in order to achieve at least one-sided sealing, the wall panels are opened up to form the top, bridges of synthetic plastics material being moulded in between the wall panels which are thus disposed.

A prerequisite of this method is that the shape of the bottom of the liquids package in question is entirely optional. It is further presupposed that for forming a liquids package firstly the web of carrier material of paper, cardboard or the like coated on both sides preferably with synthetic plastics materials is used to produce a tube having the suitable grooving, cutting and fold lines by gluing or sealing along a longitudinal sealing seam. The suitably cut tube is then open at the top and bottom ends. It is on a basis of this condition that the method of sealing the package on at least one side of the tube is based: it is divided into two stages, which is what guarantees the essential simplification of the sealing method or of the tool needed for it. In the first stage, in fact, the tube which has been produced is laid flat, care being taken that at least that wall panel of the top which is provided with a perforation, stamping or the like and on which the opening device is to be injection moulded is that which becomes positioned in the plane of the laid-flat tube. Obviously, simple tools can be used, between which the tube lies flat so that the injection mould dies can move towards each other until they abut the paper material, a relatively simple recess having to remain, solely for the opening device.

In the second stage which is then provided in accordance with the invention, the laid-flat tube which now carries the injection moulded opening device, is unfolded. In this state, the wall panels which are initially in the plane of the tube are so folded over along their groove lines or fold lines that they assume the area of what will subsequently be the top and it is in this configuration that the final injection moulding process then commences, whereby the synthetic plastics bridges are injection moulded between the wall panels. Here, too, the same problem arises as described hereinabove, so that obviously simple tools can be used for the second injection moulding process.

If, then, it is intended as described above to seal a similar liquids package along one side, the package also comprising a tube but a flat top with an opening device and a flat bottom then according to the invention it is advantageous if to produce this flat top in the second stage its wall panels are folded over through about 90° into the plane of the top.

In the above-mentioned first proposal of the invention, there was the advantage that simple tools can be used on a flat paper part in the first stage to mount the opening device and in the second stage to provide the bridges between the wall panels of the top. Obviously, particularly simple tools are involved and the method also becomes very rugged and insusceptible to breakdown if the top is to be constructed as a flat surface. For the latterly mentioned second proposal according to the invention, the two-stage situation is of course retained and the only additional operation is to fold the wall panels over into the desired plane of the top, and because this is substantially at right-angles to the tube, the wall panels have to be folded over through 90°.

If it is now desired, regardless of the form of the surface of the top, to seal a liquids package of the type mentioned at the outset, wherein a handle is also mounted in the region of the top, then according to a further proposal of the invention it is envisaged that in the first stage te tube is so laid flat that the anchoring device for the handle on the tube is positioned on a lateral edge of the laid-flat tube, the handle being so injection moulded on the tube that the main plane of the handle lies in the same plane as the laid-flat tube. By suitably shaping the blank for the tube, it is possible for the anchoring means for the tube on the handle, generally a cut edge, which may be straight, serrated, provided with lugs or otherwise shaped, to be placed on a lateral edge of the tube which is laid flat in the maner described. The logic behind this arrangement resides in that the main plane of the handle is disposed in a continuation of the laid-flat tube. Then, in fact, it is again possible to use simple injection moulding tools which only have recesses on the mutually opposite surfaces, in the present case for example for a half handle, because the main plane of the handle should of course according to the invention lie in the same plane as the laid-flat tube.

If in the case of a preferred embodiment of the invention it is intended to seal a liquids package which carries both an opening device on a mug or on a wall panel of the top, and also a handle, then in addition to the aforementioned measures, the invention further envisages that the handle should be injection moulded onto the tube at the same time as the opening device. In this respect, it is once again immaterial whether the top is flat or has the form of a more or less wide cone.

The basic principle of the two-stage nature of the method is however not overlooked, a distinction being drawn between the injection moulding capabilities of opening device and/or handle on the one hand and the possibility of injection moulding the synthetic plastic bridges between the wall panels of the top. Injection moulding the bridges ought in any case to occur in the second stage of the method after the tube has been opened up, whereas moulding-on of an opening device or of a handle or even both should take place in a first stage in such a way that after the tube has in the second stage been unfolded, it is already provided with the desired injection-moulded parts (opening device, handle).

The apparatus for the at last one-sided sealing of the liquids package with tube, top and bottom, the tube the bottom and at least some wall panels of the top consisting of synthetic plastics coated paper cardboard or like carrier material, the edges of the wall panels of the top being connected to one another in fluid-tight fashion by injection moulded synthetic plastics bridges, comprises an injection mould die and the counter mould die which are driven so that they move towards each other. In order to be able to carry out the first and/or second stage of the aforedescribed method, it is for the apparatus according to the invention envisaged that the injection mould die and the counter mould die should be in each case in one piece and only have recesses for the synthetic plastics bridges and/or opening device and/or handle on that surface which is towards the other die. By following this teaching, it is possible for a man skilled in the art, despite relatively complicted top structures to use a simple injection moulding machine. The man skilled in the art will scarcely have any difficulty if only the second stage of the method had to be performed, i.e. if only synthetic plastics bridges had to be injection moulded on the edges of the wall panels at the top, so long as the top is flat. In the event of such a top being of conical shape, then even the difficulties which would face a man skilled in the art can still be overcome.

It is on the other hand problematical if apart from the top formation described, it is necessary to fix an opening device in the top area or even in addition to fix a handle on the top. Here, the invention embodies the teaching that it is possible to manage with simple injection moulding dies and counter mould dies which are so disposed in groups in the machine that firstly only the opening device or the handle or both is or are moulded onto the laid-flat tube. Such mould dies can be in one piece and only need to have the recesses provided according to the invention of one surface. After leaving these first mould dies, the product, i.e. the tube, is unfolded and fed to a second mould die group or station in the overall machine where, then, the synthetic plastics bridges are injection moulded onto the edges of the wall panels of the top, once again with the same simple tools.

The grat advantage of these simple tools lies in the fact that paticularly in the case of heavy duty machines, where a very large number of packages have to be sealed in the described manner in a unit of time, a plurality of the described simple injection moulding tools are disposed serially and are able to be moved simultaneously.

A further advantage of the mould dies which are disposed and constructed in this way is that where a plurality of pairs of moulds are disposed one after the other it is only necessary to apply a force from the outside on the outermost mould dies for all the moulds to be closed tightly and simultaneously. This closure can be carried out with considerable force, because the individual mould dies are compressed as far as the paper. In other wods, the mould dies are braced on one another thorugh the paper. Thus, it is possible to respect an accurate dimension in respect of the cavities for opening devices, handles, synthetic plastic bridged etc. With such a development of mould dies, it does not happen that one moulding tool has to be kept apart from the other and under control just because one mould cavity has to be advanced by itself through the tool surfaces. In other words, therefore, it is not the tool parts which are disposed on a relatively long mechanical path which constitute the actual abutments, so that with disadvantage the actual mould cavity might, due to tolerances and deformations, perhaps be too small or too large, but instead according to the invention the paper lies between them because actually on the mould cavity, the mould dies are really braced on the paper. All these advantages accrue from the flattened state of the tube in the first stage or in the separation of the second injection moulding stage for the synthetic plastics bridges of the top wall panels.

BRIEF DESCRIPTION OF THE DRAWING

Further advantages, features and possible applications of the present invention will arise from the ensuing description taken in conjunction with the attached drawings, in which:

FIGS. 1 to 4 show the tube 1 of bilaterally synthetic plastics coated paper formed into a tube by a longitudinal seam 2.

DESCRIPTION OF THE PREFERRED EMBODIMENTS

Figure 1:
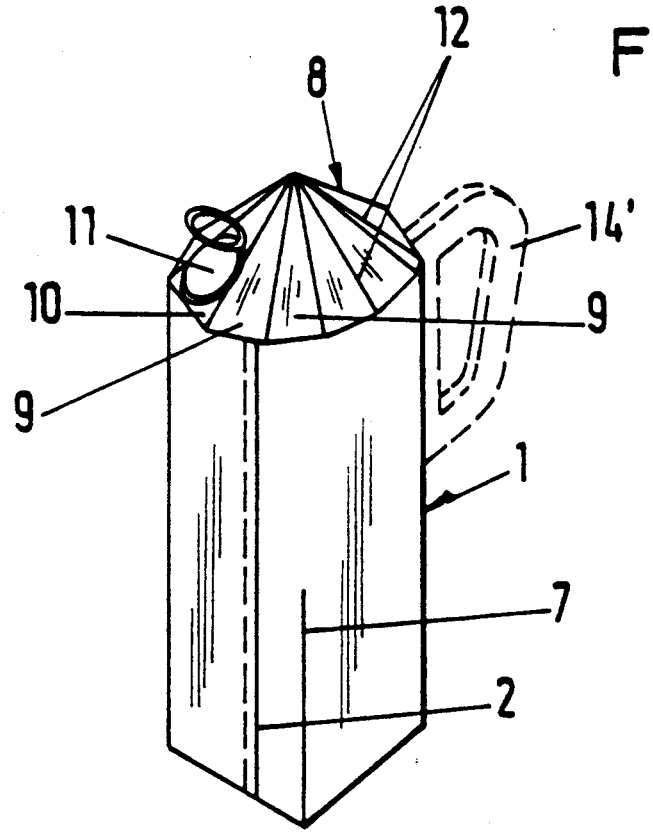
FIG. 1 is a perspective view of a first embodiment of liquids package in the finished and sealed state.
Figure 2:
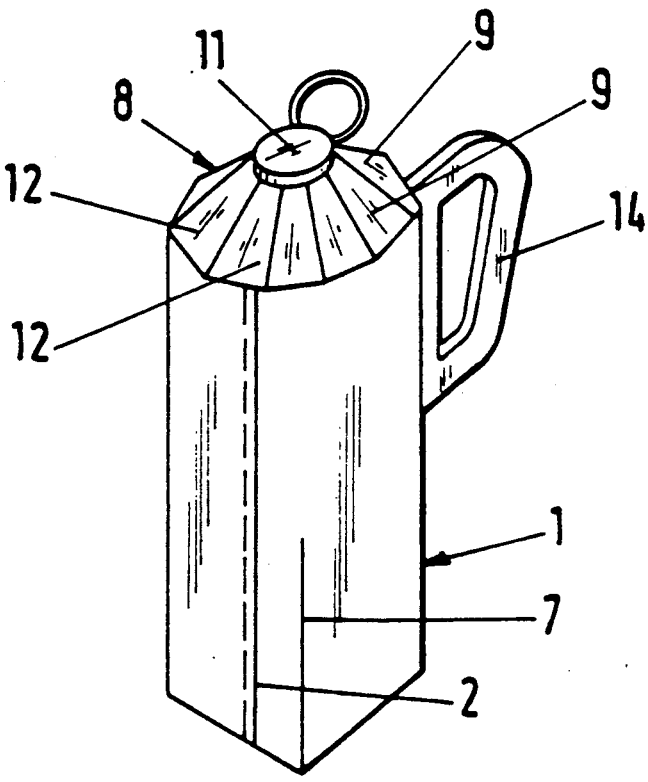
FIG. 2 is a perspective view of another form of package in which the opening device is disposed in the middle of a conical top.
Figure 3:
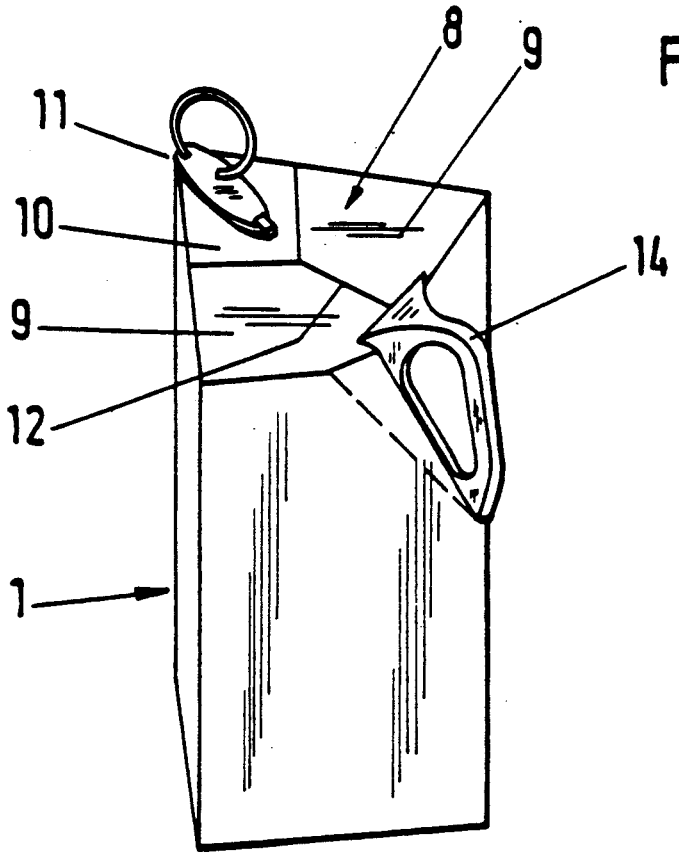
FIG. 3 shows another type of package with the opening device and handle, in a parellelepiped shape.
Figure 4:
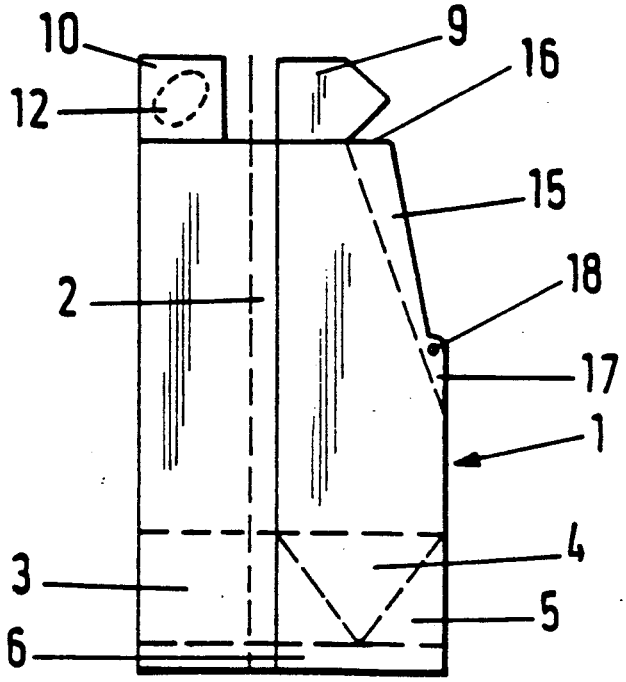
FIG. 4 shows the flattened tube of a liquids package which is not shown here and FIG. 5 diagrammatically shows the construction of a heavy duty tool for one stage of the method, in this case the injection moulding of openign device and handle.

Where the examples of embodiment shown in FIGS. 1 to 3 are concerned, the bottom is flat and formed by folding over the wall panels 3, 4 and 5 and the transverse seam 6 which can to a certain extent be seen in the case of the tube shown in FIG. 4. From the four corners of the bottom, therefore, fold lines extend along the tube 1 to the top end and of these, in the case of the embodiments shown in FIGS. 1 and 2, the majority are purely transition fold lines, as shown at 7, and then in the upper portion the top is polygonal and may of course even be circular. The top which is generally designated 8 in all the embodiments consists of folded over wall panels 9 and 10, the wall panel 10 in each case differing from the panels 9 in that (in the case of the embodiments in FIGS. 1, 3 and 4) it is provided with the opening device 11 or with the laid-flat tube in FIG. 4, with the perforation line 12 for the attachment of an opening device 11. The special construction of the opening device 11 is immaterial for the purposed of the present description because different developed construction with or without a tear-open handle may be used. The edges 12 between the wall panels 9, 10 are provided with injection moulded synthetic plastics bridges 13 according to the diagrammatic cross-sectional view in FIG. 2a. In FIGS. 2 and 3, in the region of the top 8, there is also an injection moulded handle 14 which in the case of FIG. 1 is only shown by broken lines and designated 14', because mountign of the handle 14' may be unnecessary for a practically usable package.

The anch ng device for the handle 14, 14' is shown in FIG. 4 with the laid-flat tube 1 because it shows the cut edge 15 which extends from the upper horizontal cut line 16 at an angle to the longitudinal seam 2 and thus also longitudinal middle axis of the tube 1 obliquely outwardly and downwardly to the region of the bottom 3 to 6. Over the length 1, the right-hand edge must be regarded as uncut because via this folded edge, the front and rear faces of the tube which are shown laid flat in FIG. 4 are connected. In the middle portion, under the oblique cut edge 15, there is a triangular lug 17 with a hole 18 into which, upon integral moulding of the handle 14, 14' the synthetic plastics material can pass like a rivet, so that the synthetic plastics handle 14, 14' is rigidly anchored on the paper.

Figure 5:
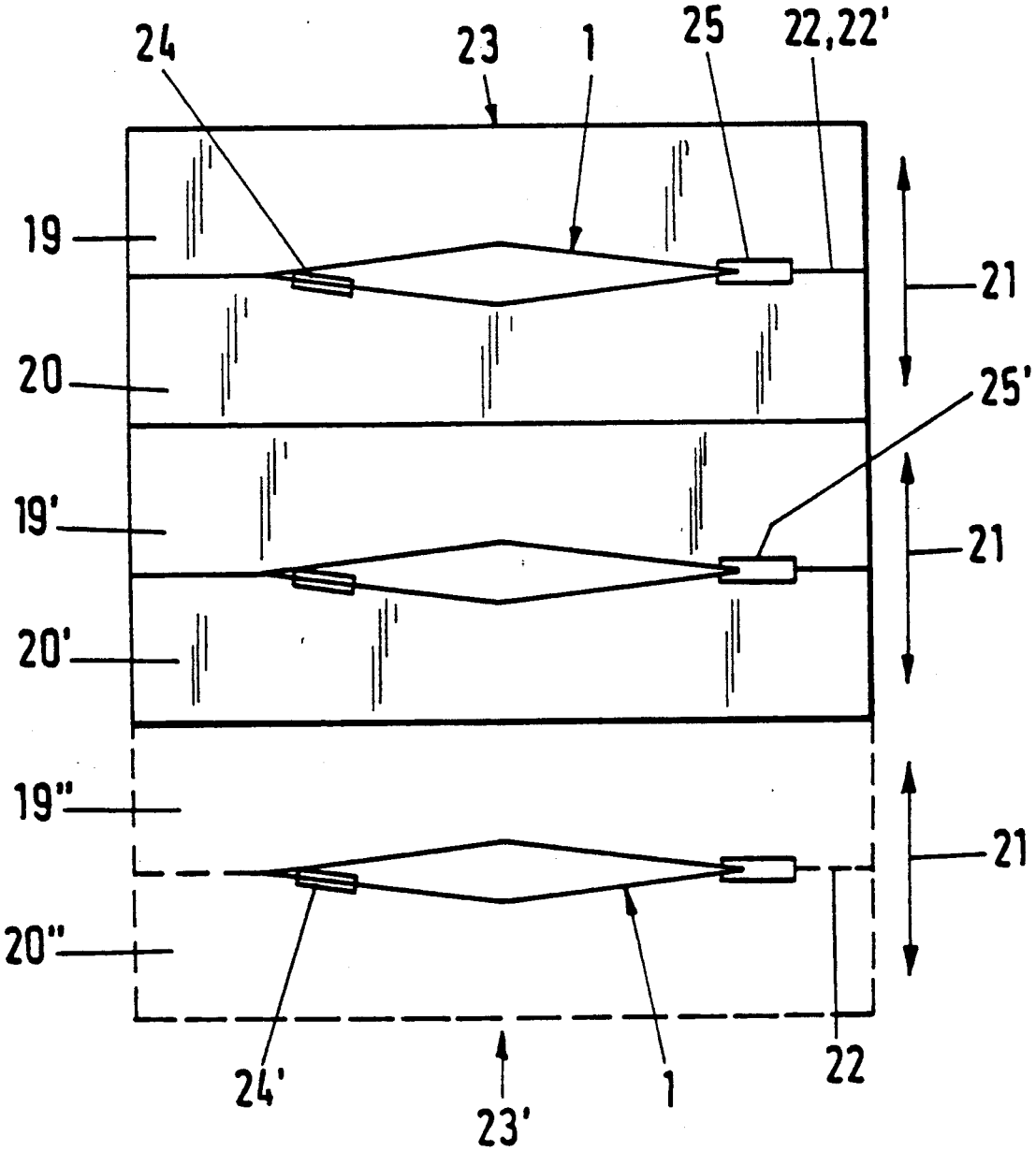

FIG. 5 diagrammatically shows the plan view of a group of pairs of moulding tools for carrying out the method described at the outset. This drawing shows injection mould dies 19, 19' of 19'' and counter mould dies 20, 20' or 20''. Three adjacently disposed pairs of mould members are shown here in a diagrammatic sectional view, the bottommost pair being shown by broken lines as a way of indicating that more or fewer of these pairs of moulds can be used in one machine. According to the arrows 21 shown on the right, each pair of moulds is adapted to be moved apart or together in a direction not shown. FIG. 5 shows in an exaggerated form and in a bent-apart view, the laid-flat tube 1 between each pair of dies 19, 20, the reader being required to understand that the tube is not "laid flat " in the opened out form shown in the drawing but is actually pressed flat from above, as into one line. Such a line would however render illustration and understanding difficult. The separating line 22 between the relevant injection mould dies and counter mould dies 20 does however also constitute the plane 22' in which the tube 1 becomes positioned when laid flat in the first stage of the method. Therefore, the mould dies are able to move in the direction of the arrows 21 and also in the opposite direction at right-angles to this plane 22, 22'. In the moved-together injection moulding situation shown in FIG. 5, it is only necessary to apply forces from outside as indicated by the arrows 23, 23' for the mould dies 19, 20 etc. to be pressed against one another under the desired pressure. Only the mould cavities 24, 24'' are left, for instance for the opening device 11 just as the mould cavities 25, 25' may be left for the handle 14, 14' alongside the cut edged of the tube 1. The injection moulding passages for the plastics material which is extruded in fluid form are not shown here because a man skilled in the art would be familiar with these details from conventional machines.

Figure 2A:
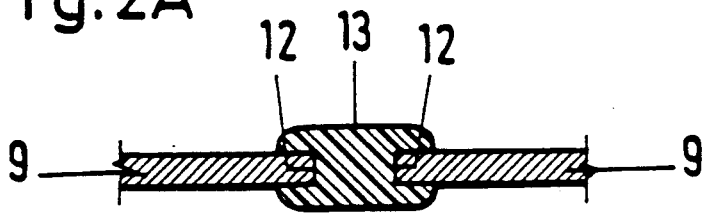

In operation, firstly the relevant pair of dies 19, 20 are opened, the tube 1 is laid flat and placed in position and then the dies 19, 20 move together, synthetic plastics material is injected into the cavities 24, 25, cools and hardens. The dies 19, 20 are then moved apart in the direction of the arrow 21, the laid-flat tube 1 is taken out and unfolded into an open state in a second stage so that it can be fed to the corresponding tools of a second stage where the syntehtic plastic bridges 13 can as shown in FIG. 2a be incorporated between the edges 12 of the wall panels 9 of the top 8, the wall panels 9 of the top 8 being rigidly connected to one another in the process.

The claim:

1. A method of sealing at least one end of a liquids package, with a tube, a top having wall panels having an opening means, a handle and a bottom and at least some of the wall panels of the top consisting of synthetic plastics coated carrier material, which method comprises the steps of first laying flat an already formed tube, open at the top and bottom in a plane so that at least the wall panel having the opening means is positioned in this plane, and so that an anchoring device for the handle is positioned on a lateral edge of the laid-flat tube and a handle is injection molded onto the tube so that the main plane of the handle lies in the same plane as the laid-flat tube so that the handle is fixed in the region of the top of the package and simultaneously the opening means is injection moulded into place, and then the tube together with the opening device is unfolded and for at least one-sided sealing, its wall panels are folded over through about 90 degrees into the plane of the top to produce a flat top and synthetic plastics bridges are injection moulded between the thus disposed wall panels, the edges of the wall panels of the top thus being connected to one another in sealing tight manner by the said injection moulded bridges of synthetic plastic material.

* * * * *

UNITED STATES PATENT AND TRADEMARK OFFICE

CERTIFICATE OF CORRECTION

PATENT NO. : 5,052,994

DATED : October 1, 1991

INVENTOR(S) : Hans-Peter Aeschlilmann

It is certified that error appears in the above-indentified patent and that said Letters Patent is hereby corrected as shown below:

In Column 4, line 46, delete the word --grat-- and insert therefore --great --.

In Column 4, line 61, delete the word --wods-- and insert therefore "words".

In Column 4, line 62, delete the word --thorugh-- and insert therefore "through".

In Column 5, line 55, delete the word --purposed-- and insert therefore "purposes".

Signed and Sealed this

Fifth Day of July, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,052,994

DATED : October 1, 1991

INVENTOR(S) : Hans-Peter Aeschlimann

It is certified that error appears in the above-indentified patent and that said Letters Patent is hereby corrected as shown below:

On the title page: The inventor's name - delete "Aeschililmann" and insert therefor --Aeschlimann--.

Signed and Sealed this

Fifteenth Day of November, 1994

*Attest:*

Bruce Lehman

BRUCE LEHMAN

*Attesting Officer*

*Commissioner of Patents and Trademarks*